United States Patent [19]

McNaney

[11] 4,453,160

[45] Jun. 5, 1984

[54] MESSAGE CHARACTER IMAGE PROJECTION CONTROL MEANS

[76] Inventor: Joseph T. McNaney, 8548 Boulder Dr., La Mesa, Calif. 92041

[21] Appl. No.: 536,546

[22] Filed: Sep. 28, 1983

[51] Int. Cl.[3] ..... G08B 5/36

[52] U.S. Cl. ..... 340/815.27; 340/783; 350/358

[58] Field of Search ..... 340/815.27, 815.06, 340/783; 350/358

[56] References Cited

U.S. PATENT DOCUMENTS

| | | | |
|---|---|---|---|
| 3,611,891 | 12/1971 | McNaney | 340/783 X |
| 3,636,837 | 1/1972 | McNaney | 340/783 X |
| 3,653,067 | 3/1972 | McNaney | 340/783 X |
| 4,158,486 | 6/1979 | McNaney | 350/358 |
| 4,179,689 | 12/1979 | McNaney | 340/815.06 |
| 4,240,715 | 12/1980 | McNaney | 350/358 |
| 4,251,806 | 2/1981 | McNaney | 340/815.27 |
| 4,280,755 | 7/1981 | McNaney | 350/358 |
| 4,330,178 | 5/1982 | McNaney | 350/358 |
| 4,390,875 | 6/1983 | McNaney | 340/815.27 |

*Primary Examiner*—John W. Caldwell, Sr.
*Assistant Examiner*—Daniel Myer

[57] ABSTRACT

Message character image projection control means for establishing conditions which simulate the eye glass or contact lens needs of an individual utilizing acousto-optic light refracting principles wherein a pair of acousto-optic cells, positioned in the line of sight of an observer, are controlled in a manner necessary to permit a viewing of the characters with a desired degree of sharpness and clarity.

3 Claims, 2 Drawing Figures

0-order path
1.3cm
1.3cm
1.3cm
X
Y
light source
ON-OFF circuits
clock circuit

MESSAGE CHARACTER IMAGE PROJECTION CONTROL MEANS

BACKGROUND OF THE INVENTION

The invention relates to this inventor's image projection control system in an application Ser. No. 359,135 filed Mar. 17, 1982, now U.S. Pat. No. 4,390,875—which is a continuation-in-part of an application Ser. No. 201,179 filed Oct. 27, 1980, now abandoned. In the aforesaid applications a system of first and second acousto-optic optical control means are utilized as the principal means for establishing light reflecting conditions and corresponding optical path relationships between an illuminated message character and a common optical axis of the system, and thereby providing for a viewing of an image of the character along said common optical axis.

SUMMARY OF THE INVENTION

The optical system means of this invention for making determinations of eye glass or contact lens refraction requirements include the use of an array of message characters of the type which are normally used for eye test purposes, a source of light and means for exposing characters of the array to light from said source. Optical means utilizing first and second (X & Y) acousto-optic light reflector cells are positioned along a common optical axis for establishing optical path relationships between individual ones of the message characters and the optical axis so as to provide for a viewing thereof from along this axis; an eyeball of an observer (or an eye patient) doing the viewing. In the process of establishing the required optical path relationships and conditions for such viewing along the optical axis, the light reflecting conditions within the interaction media of the pair of acousto-optic cells, in each instance, perform a simulating of the lens requirements of the observer to view the character with a desired degree of sharpness and clarity; this being an important objective of the invention. Another objective of the invention is to improve upon the accuracy of available means in the providing of such eye care needs. Still other objectives of the invention include such abilities in the detection and specifying of corrective lens needs by means of easy to operate electro-optical system means.

Embodiments of the invention illustrated and described herein exemplify the means for meeting these objectives, and when read in connection with the drawing herein the description which follows will provide a better understanding of these and still other objectives and advantages of the invention.

DESCRIPTION OF THE INVENTION

Figures 1, 2:
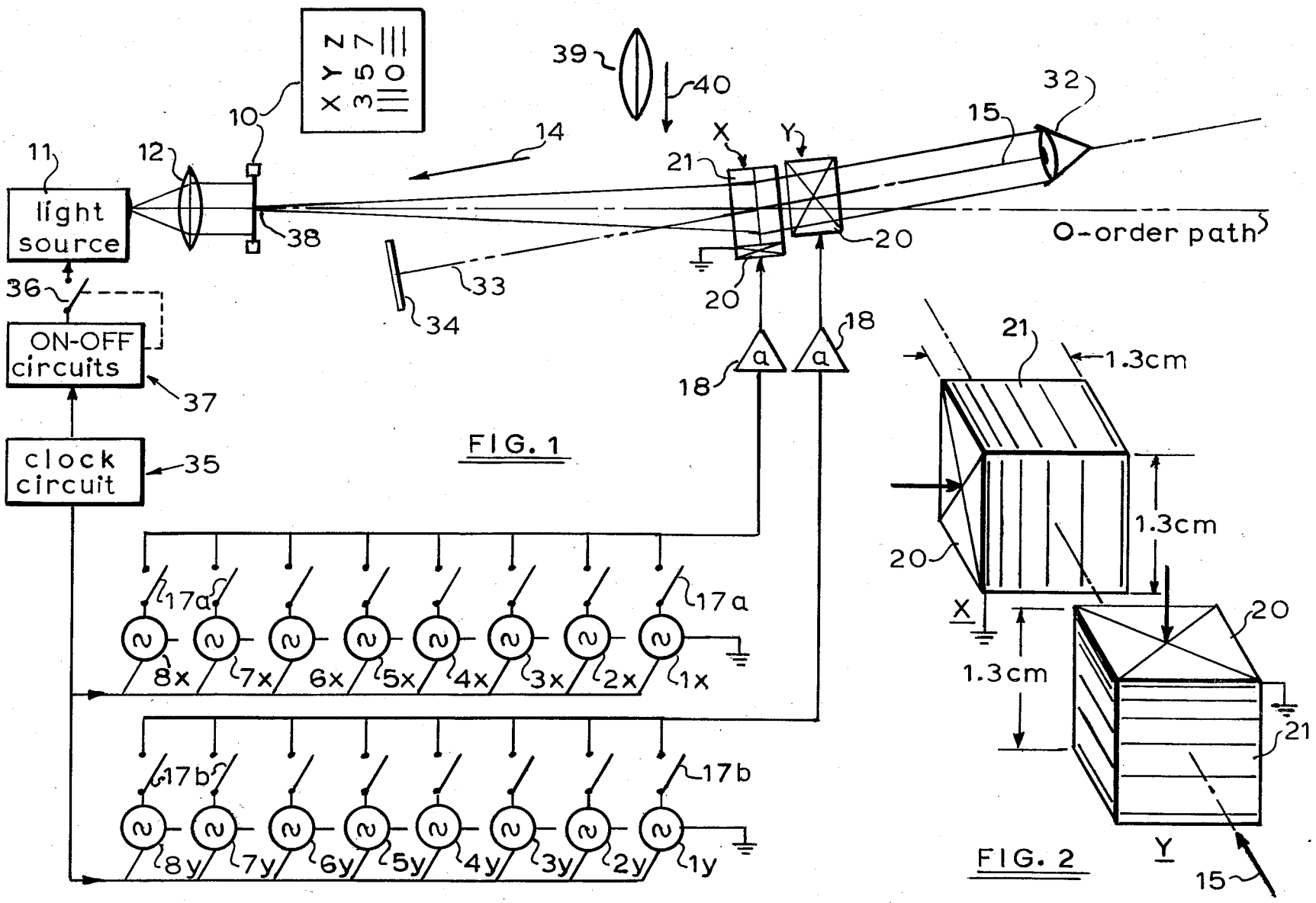
FIG. 1 is to exemplify schematically optical relationships of key elements and operating circuit means of one embodiment of the invention.
FIG. 2 represent schematically a pair of X & Y a-o cells, enlarged somewhat, to which reference will be made in discussions thereof.

Referring now to FIG. 1, an array of message characters of what will be referred to as an eye chart 10 from which selectively high quality images thereof will be available for viewing upon an exposure to light from a source 11. Being shown as but one example, such chart can be made to contain still other formations of characters, type fonts and sizes. All reference herein to the use of the word "light" is to be understood as including radiant energy extending from infrared, through the visible spectrum, to ultraviolet. Light from the source 11 is preferably monochromatic, but the invention is not to be limited in this regard. The chart can have opaque characters and transparent or translucent field or background, in which they are located, or the reversal of this. And it should be understood that such chart 10 can be illuminated from the side thereof opposite to that indicated and, for example, in the direction of the arrow 14. Then, either the characters or the field will be made a reflector of light.

Optical system means including first and second acousto-optic optical path relationship control means, which will herein be referred to as including, respectively, an X a-o cell and a Y a-o cell, each having an ultrasonic frequency transducer 20, and an interaction medium 21 positioned along a common optical axis 15 of the system. These X & Y a-o cells are utilized in an operation of establishing images of individual characters stemming from the chart 10 along the optical axis 15. This operation includes an extending of predetermined ultrasonic frequency voltages to the transducers 20 of the cells which will hereinafter be described. Regarding a functioning of an acousto-optic cell, when responding to an extending of voltages of ultrasonic frequencies the interaction medium 21 of a cell is traversed by compression waves effecting periodic stratification of the medium and wherein the density is proportional to the applied acoustic power. The distance between two successive planes of maximum density is equal to the wavelength of the applied voltage. Each device is designed and positioned along the optical axis 15 whereby the orientation of a given strata agrees substantially with the Bragg angle relative to the O-order path for light rays through the medium 21. Under such conditions the periodic stratification of the medium allows it to take the form of, and behave like, a stacked array of planar light guides, each presenting a graded index profile and a path for a viewing of light therethrough. Such path includes a bending thereof corresponding to the wavelength of a given stratification within the medium 21.

At a second, and extreme, end of the common optical axis 15 there is shown a symbol 32 exemplification of an observer's eye. In the absence of any signal voltages to either of the a-o cells a line of sight will extend from the eye 32, along the axis 15, through the media 21 and along an optical path 33 to a stop 34. Then, under the influence of a prescribed set of signal voltages to the X & Y a-o cells the eye of the observer will be allowed to see in the direction of the chart 10; the media of the cells being made to function as a pair of cylindrical lenses, oriented perpendicularly one in relation to the other.

Although the invention is not to be limited insofar as the following voltage source detailing is concerned, the ultrasonic frequency voltage source will be described as including the use of eight individual generators **1*x* through 8*x* and 1*y* through 8*y*. Each of the generators will provide a predetermined range of frequencies and each designed to effect a linear frequency modulation and consequently a cylindrical lensing effect, selectively, in the line of sight along the axis 15**. The generators and their respective range of available output frequencies are listed as follows:

| |
|---|
| generators 1x & 1y frequency range is 100 MHz to 110 MHz |
| generators 2x & 2y frequency range is 100 MHz to 120 MHz |
| generators 3x & 3y frequency range is 100 MHz to 130 MHz |
| generators 4x & 4y frequency range is 100 MHz to 140 MHz |
| generators 5x & 5y frequency range is 100 MHz to 150 MHz |
| generators 6x & 6y frequency range is 100 MHz to 160 MHz |
| generators 7x & 7y frequency range is 100 MHz to 170 MHz |
| generators 8x & 8y frequency range is 100 MHz to 180 MHz |

The output of the generators 1*x* through 8*x* will be connected to the transducer 20, selectively, upon the closing of a desired one of the series of switches 17*a*. The output of the generators 1*y* through 8*y* will be connected to the transducer 20, selectively, upon the closing of a desired one of the series of switches 17*b*. The transducers 20 being, respectively, of the X & Y a-o cells. The output of each generator is connected to their respective transducer through an amplifier 18.

In FIG. 2 the X & Y a-o cells are again shown, schematically, and enlarged somewhat. Regarding the media 21, the use of tellurium dioxide, $TeO_2$, is preferred since it has a favorable acoustic velocity of $0.6\times10^5$ cm/sec. But still other related materials can be considered for use as well. To the observer's eye 32 from along the axis 15, the aperture of the a-o cells will be described as each having a dimension of 1.3 cm×1.3 cm. The acoustic velocity indicated amounts to a transit time of 0.00002 sec. through such length dimension of the medium 21 for each sinusoidal stratifying thereof. During the time period of 0.00002 sec. the interaction medium will have been filled with a series of individual cycles of the periodic stratification; each of which presenting a shorter wave length with time. This initial filling of the medium utilizing a predetermined portion of the range of frequencies stemming from a given generator represents an initiating of a cylindrical lensing effect and to the eye of the observer a focusing on a finite line along one edge of the eye chart 10. With time the remaining portion of the range of frequencies from the generator allows the cylindrical lensing effect to continue until such focusing on the chart has extended to the opposite edge thereof.

The establishing of these cylindrical lensing effects in the media 21 of the X & Y a-o cells can be programmed so as to become effective either simutaneously or one following the other. When the system is in a normal operating mode each of the generators therein will be in operation and ready to have extended a selected pair of ultrasonic frequencies to the X & Y a-o cells. The number of times per second their respective range of frequencies will be repeated will be under the control of clock circuit 35, and the number of times per second can be, for example, 100, or just enough so as to provide a flicker-free viewing of message characters by the eye 32 of the observer.

The light source 11 can take the form of a helium neon light source or such other source of light. It should also be understood that the use of a laser diode can be included in the system as a light source. The exemplification of the switch means 36 and ON-OFF circuits 37 will, of course, be high speed electrical circuit switch means, which will allow the light source to be controlled ON and OFF in accordance with the presence of cylindrical effects in the media 21, or left ON for longer periods of time. In any event the intensity can be low enough so as not to be harmful to the eyes.

In practise the observer (or eye patient) may begin the operation by a closing of a pair of x and y switches 17 to establish at least a first predeterined one of light reflecting conditions in media 21 of the X & Y a-o cells with an object of establishing an optical path relationship between message characters of the eye chart 10 and the eye 32 along the optical axis 15. An opening and closing of switches 17 can continue until it has been learned which one of a series of predetermined light reflecting conditions permit the eye 32 of the observer to view a predetermined character with the highest degree of sharpness. This will be followed by a further opening and closing of switches 17 with the object of attempting to view a most difficult character to see with the highest degree of sharpness and clarity. The more extensive the number of different ultrasonic frequencies made available in the system for use by the observer the better it will be in meeting the objectives of the invention. Therefore, the invention is not to be limited to the number of frequency voltages illustrated.

A lens 39 exemplifies the use of an auxiliary optical means which can be introduced in the system by a repositioning thereof in the direction of the arrow 40. Such lens can permit the invention as hereinbefore described to greatly extend an overall lens providing means of the invention. By first establishing an approximation of given lens requirement of a patient with the aid of a lens 39, for example, the cylindrical lens simulating procedure as herein disclosed using the X & Y a-o cells will be utilized.

It should be understood by those skilled in the arts pertaining to the construction and application possibiities of the invention herein set forth that the embodiments included herein illustrates in a very limited sense the usefulness of the invention, and that the invention includes other modifications and equivalents as they may be seen by those skilled in the arts, but still being within the scope of the appended claims.

I claim:

1. In an optical system including an array of message characters, a source of light and means for exposing message characters of said array to light from said source, and optical means positioned along an optical axis of said system for establishing individual optical path relationships between said array of message characters and said optical axis for allowing a viewing of predetermined ones of said characters by a human eyeball from along said optical axis, wherein the improvement comprises:

(a) said optical means including first and second acousto-optic optical path relationship control means and each said control means including an ultrasonic frequency transducer and an interaction medium positioned along said optical axis, and a source of ultrasonic frequency voltages and circuit means for connecting said transducers to this source of voltages for an establishing of any of a number of different acoustic wave light reflecting conditions within the interaction medium of said first control means and within the interaction medium of said second control means, each said optical path relationship corresponding, respectively, to a combination of said light reflecting conditions of said first and second control means;

(b) means for establishing a predetermined one of said light reflecting conditions within said medium of the first control means and a predetermined one of said light reflecting conditions within said medium of the second control means and establishing a corresponding one of said optical path relationships between predetermined ones of the message characters of said array and said human eyeball from along said optical axis;

(c) said exposing of message characters of said array to light from said source including a flooding of the entire array of said message characters, simultaneously, with light from said source of light, said flooding of the entire array of message characters allowing said viewing of predetermined ones of said characters by said human eyeball from along said optical axis.

2. The invention as set forth in claim 1, including an auxilliary system of lenses for being introduced into said optical system along the optical axis thereof and intermediate said acousto-optic optical path relationship control means and said array of message characters.

3. In a message character eye visibility test optical system including illuminated message characters positioned at a first end of said system and the positioning of an eye of a patient at a second end thereof, and optical means positioned along an optical axis of said system intermediate said illuminated characters and said eye for an establisning of any of a number of different optical path relationships between the illuminated characters and the eye of the patient in a process of examining the degree of sharpness of predetermined ones of said characters to the eye of the patient, wherein the improvement comprises:

(a) said optical means including first and second acousto-optic optical path relationship control means and each said control means including an ultrasonic frequency transducer and an interaction medium positioned along said optical axis, and a source of voltages representative of a series of individual ranges of ultrasonic frequency voltages and circuit means for connecting said transducers, respectively, to selected ones of said ranges of ultrasonic frequency voltages for an establishing of any of a number of related linear frequency acoustic wave modulations and corresponding light reflecting conditions, respectively, within the interaction medium of said first and second control means, each said optical path relationship corresponding, respectively, to a combination of said light reflecting conditions of said first and second control means;

(b) means for establishing predetermined ones of said light reflecting conditions, respectively, within the interaction medium of said first and second control means and a corresponding one of said optical path relationships between a predetermined one of said illuminated characters and said eye of the patient for an allowing of said examining of the degree of sharpness of said predetermined one of the illuminated characters to the eye of the patient from along said optical axis of the system.

* * * * *